United States Patent [19]

Vitonis

[11] Patent Number: 4,574,415

[45] Date of Patent: Mar. 11, 1986

[54] CONVERTIBLE BLIND CLEANER

[76] Inventor: Frank Vitonis, 530 W. Wilson, Costa Mesa, Calif. 92627

[21] Appl. No.: 689,169

[22] Filed: Jan. 7, 1985

[51] Int. Cl.[4] ..... A47L 13/12

[52] U.S. Cl. ..... 15/114; 15/160; 15/206; 15/210 A; 15/247; D4/119

[58] Field of Search ..... 15/247, 160, 210 A, 15/210 R, 394, 114, 206, 218.1, 102; D4/119, 121, 122, 129, 137, 138; D32/52

[56] References Cited

U.S. PATENT DOCUMENTS

| | | | |
|---|---|---|---|
| 897,286 | 9/1908 | Haskell | 15/247 |
| 2,172,479 | 9/1939 | McMillen | 15/160 X |
| 3,520,018 | 7/1970 | Zaidan | 15/394 |
| 3,965,521 | 6/1976 | Wardell | 15/114 |
| 4,400,842 | 8/1983 | Vitonis | 15/210 A |
| 4,435,874 | 3/1984 | Jacobson | 15/210 A |
| 4,483,037 | 11/1984 | Jacobson | 15/210 A |

*Primary Examiner*—Peter Feldman
*Attorney, Agent, or Firm*—Thomas P. Mahoney

[57] ABSTRACT

A convertible dusting and cleaning brush for venetian blinds and the like having a brush frame with a handle thereupon, said frame mounting a plurality of juxtaposed, finger-like, bristle dusting brushes extending longitudinally therefrom. Demountably associated with each of said brushes is a cleaning adapter whose outer diameter is substanially equal to the outer diameter of the dusting brushes and which incorporates an elongated bore adapted to receive the filaments of the elongated brush when the cleaning adapter is installed thereupon. As the installation takes place, the filaments of the brush compressed to impart a frictional grip by the filaments upon the wall of the bore of the cleaning adapter, thus preventing the inadvertent dislocation of the cleaning adapter from operative relationship with the associated brush. Positive detent means is also provided on the frame to hold the adapter on the brush.

4 Claims, 5 Drawing Figures

CONVERTIBLE BLIND CLEANER

BACKGROUND OF THE INVENTION

This invention relates to a convertible dusting and cleaning brush assembly for venetian blinds and the like, and, more particularly, to a brush having a brush mounting frame with a plurality of juxtaposed, finger-like brushes extending longitudinally from said frame and constituting a first set of dusting elements. Operatively associated with the dusting elements is a plurality of cleaning elements disposed in overlying relationship with the dusting elements and adapted to be retained in operative relationship therewith by the brush filaments of the individual brushes and positive detent means on said frame.

Consequently, the dusting and cleaning assembly is capable of providing two correlative functions by the use of one unit, namely, the use of the brushes to dust the venetian blinds or the like and the use of the cleaning elements to wash or otherwise clean detritus deposited on the slats of the venetian blind which is not readily removable by the dusting brushes.

It is well known to those skilled in the art that a new type of venetian blind known as a mini-blind has achieved huge success in the window decorating field. Such blinds are characterized by relatively small individual slats instead of the bulky, relatively broad slats which were previously utilized in prior art venetian blinds.

Because of the relatively miniature nature of the blind slats of the new mini-blinds, the number of slats in a blind is much greater than in conventional blinds incorporating relatively large, bulky slats and greater difficulty has been encountered in dusting and cleaning the mini-blinds.

Recently, numerous dusting brushes have been placed upon the market, among them the dusting brush disclosed in U.S. Pat. No. 4,400,842 invented by me.

Examples of prior art dusting brushes intended to be utilized with conventional blinds are disclosed in U.S. Pat. Nos. 2,134,965, 2,269,424, 2,350,221, 2,533,829 and 2,562,230.

Conventional dusting brushes, while they are capable of removing superficial dust deposited upon the surfaces of mini-blinds and the like, are not capable of removing other types of detritus deposited thereupon such as water spots, finger marks and the like. This is due to the fact that the bristles of the brushes, while they are capable of dislodging the dust, cannot remove the more resistant stains constituted by water spotting, finger blemishes and grease deposits.

OBJECTS AND SUMMARY OF THE INVENTION

It is, therefore, an object of my invention to provide a convertible dusting and cleaning brush assembly for venetian blinds and the like which includes a plurality of finger-like brushes constituting a first set of dusting elements and a second set of cleaning elements constituted by a plurality of adapters capable of being installed in overlying relationship with the aforementioned brushes and incorporating fibrous, filamentary sheaths fabricated from natural or synthetic materials capable of absorbing water, cleaning solutions or the like so that actual cleaning of the blind slats may be achieved by utilization of the adapters.

In other words, when the brushes are utilized, the lighter dust deposits can be readily brushed from the surfaces of the blind slats. However, when it is desired to remove more resistant deposits such as those mentioned in detail hereinabove, the adapter sheaths can be installed in operative relationship with the brushes by sliding them into overlying relationship with the filaments of the brushes, thus permitting the adapter sheaths to be utilized in washing and thorough cleaning of the slats of the blind.

Another object of my invention is the provision of a combined dusting and cleaning brush of the aforementioned character wherein the adapters each incorporate a bore having a diameter substantially less than the outer circumference of each of the brushes so that, when the adapters are inserted in operative relationship with the brushes, the filaments of the brushes will be compressed to retain the adapters in operative relationship with the brush assembly.

A further object of my invention is the provision of a brush of the aforementioned character wherein positive detent means is provided on the brush mounting frame to more securely retain the adapter sheaths or sleeves in operative relationship with said frame. The detent means can, obviously, consist of a wide variety of expedients, but I have found that suitable detent means can be provided on the frame, said detent means consisting of prongs extending coaxially with said brushes and being receivable in the bore of said adapter sleeves to firmly retain said sleeves in operative relationship with said brushes during the more intensive washing or cleaning process for which said sleeves are utilized.

Other objects and advantages of the invention will be apparent from the following specification and the accompanying drawing, which is for the purpose of illustration only.

DESCRIPTION OF THE BEST EMBODIMENT OF THE INVENTION

Figure 1:
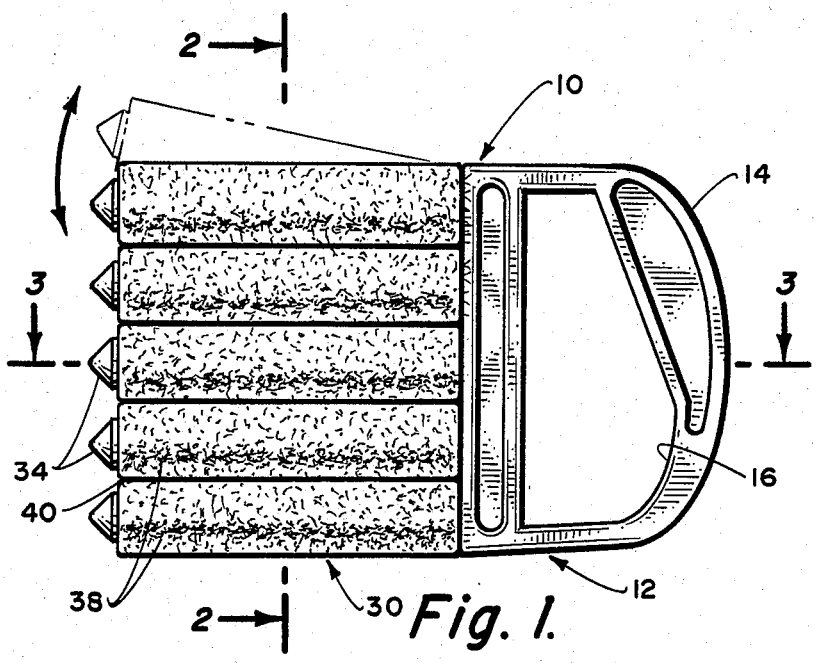
FIG. 1 is a side elevational view of a combined dusting and cleaning brush assembly manufactured in accordance with the teachings of my invention.
Figure 4:
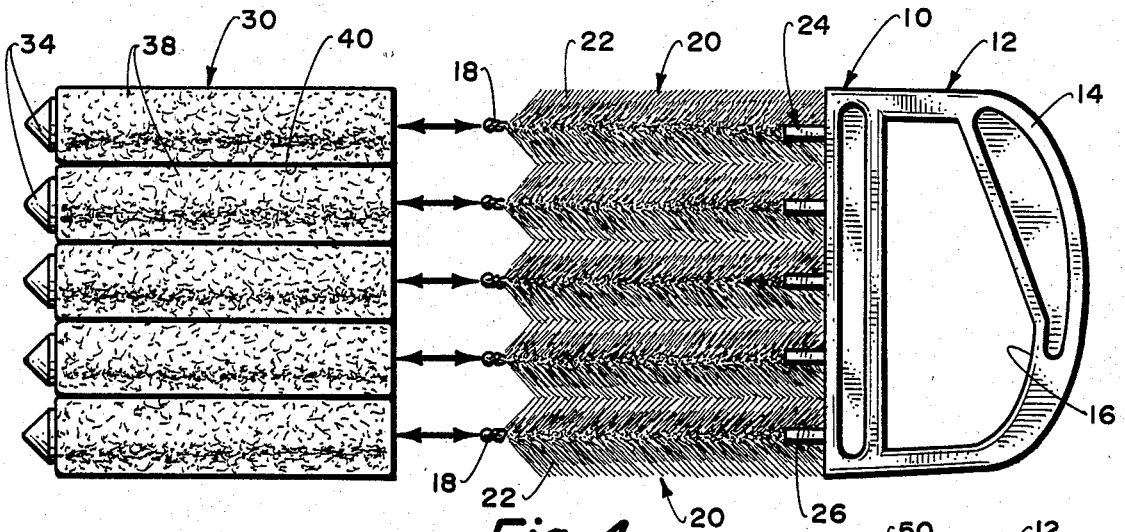
FIG. 4 is a view showing the adapter sleeves removed from operative relationship with the associated brushes.

Referring to the drawings, and particularly to FIGS. 1 and 4 thereof, I show a convertible venetian blind duster and cleaner 10 which includes a brush mounting frame 12 having a handle 14 which includes an opening 16 for the reception of the fingers of the person utilizing the brush assembly.

The brush mounting frame 12 is preferably formed of one-piece injection molded plastic and, simultaneously with the injection molding of the frame 12, the twisted wire filament retainers 18 of the elongated finger-like brushes 20 are molded into the frame. The filaments or bristles 22 of the brushes can be formed from nylon or other synthetic plastic materials and the diameter of the brushes constituted by the filaments is such that the ends of the filaments are juxtaposed to one another and to the filaments of adjacent brushes.

Figure 2:
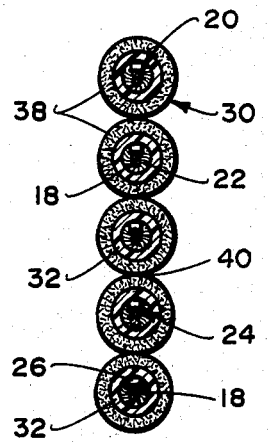
FIG. 2 is a transverse sectional view taken on the broken line 2—2 of FIG. 1.
Figure 3:
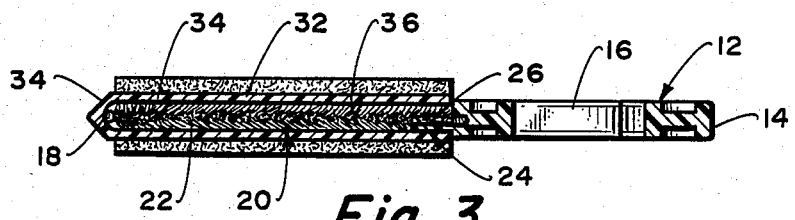
FIG. 3 is a longitudinal sectional view taken on the broken line 3—3 of FIG. 1.

Formed integrally with the brush frame 12 are detent means 24 constituted by elongated resilient detent prongs 26 which, as best shown in FIGS. 2 and 3 of the drawings, extend coaxially of the twisted wire brush retainers 18 for a purpose which will be described in greater detail below. Although the detent means 24 are shown as formed integrally with the brush frame 12 from synthetic plastic material, it will be obvious to those skilled in the art that other types of detent means can be provided such as metallic spring fingers or the like and it is not intended that the teachings of the invention be limited to the particular detent means illustrated and described herein.

The first set of cleaning elements constituted by the brushes 20 is particularly adapted to be utilized to remove the relatively light dust deposits which accumulate upon the surfaces of venetian blind slats. The close juxtaposition of the ends of the filaments of the respective brushes to one another insures that intimate contact of the brushes with the surfaces of the blind slats can be achieved and further insures that all loose dust deposits thereupon can be readily removed.

However, there are other deposits and detritus encountered on venetian blind slats which cannot be removed by the utilization of the first set of cleaning elements constituted by the brushes 20 and it is for this purpose that I have provided a second set of cleaning elements constituted by a plurality of adapter sheaths or sleeves 30 which, as best shown in FIGS. 1-4 of the drawings, each includes a hollow core 32, provided, in the present embodiment, by an injection molded core element 34 having an elongated bore 36 provided therein which is substantially smaller in diameter than the diameter of the brush filaments 22 of the brushes 20.

The core elements 34 are encompassed by cylindrical covers 38 formed from natural or synthetic materials and, preferably, presenting the appearance of lambswool or the like. The filaments utilized must be of such a nature that they are capable of absorbing water, cleaning solutions or the like so that, when the covers 38 engage a venetian blind slat, in a manner to be described in greater detail hereinbelow, the water or cleaning solution will remove stubborn stains from the surfaces of the venetian blind slats.

The juxtaposed portions of the perimeters of the covers 38 provide bights 40 at the interfaces between the covers 38 which materially assist in exerting a compressive force on the surfaces of the venetian blind slats being cleaned to augment the cleaning action of the cleaning solutions in which the covers 38 have been immersed.

It will be noted that, in addition to the retention force of the bristles 22 exerted upon the wall of the bore 36 of the molded core element 34 which acts to retain the adapter sleeves 30 in operative relationship with the finger-like brushes 20, the elongated resilient detent prongs 26 engage a portion of the wall of the elongated bore 36 of the molded core element 34 and provide for positive retention of the adapter sleeves 30 in operative relationship with the finger-like brushes 20.

After the adapter sleeves 30 have been utilized for their cleaning function, they can be readily removed from operative relationship with the finger-like brushes 20, dried out, and located in a storage receptacle until the next cleaning of the venetian blind slats is indicated.

When the adapter sleeves 30 become worn at the bight, they can be rotated to bring new portions of the filamentary covers into juxtaposition to one another to provide the compressive force necessary for adequate cleaning of the venetian blind slats.

Figure 5:
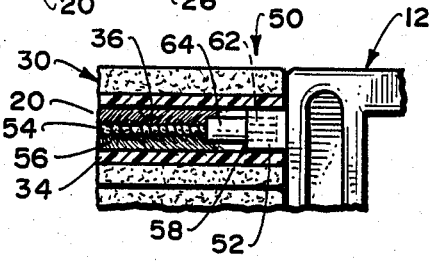
FIG. 5 is a view showing an alternative embodiment of the detent means of the invention.

Another embodiment 50 of the detent means is shown in FIG. 5 of the drawings as including a rotatable detent 52, said rotatable detent 52 being mounted for rotation on the associated brush wire 54 for a brush 56 and including a detent head 58 having a plurality of ribs 62 and a reduced shank 64.

The detent 52 is juxtaposed to the frame 12 and is adapted to be received within the elongated bore 36 of a molded core element 34 of the adapter sleeve 30 to maintain the adapter sleeve 30 in operative relationship with the finger-like brushes 20.

Of course, when the rotatable detent 52 is utilized, the rotation of the adapter sleeves 30 is facilitated because of the fact that the rotatable detent head rotates easily with the adapter sleeves 30.

Therefore, the utilization of the teachings of the invention provides a combined dusting and cleaning tool for venetian blind slats which is capable of multi-use applications and which can be used alternatively in the cleaning or dusting applications of the tool. Although mention has been made of particular types of bristle brushes and filamentary covers, it will be obvious to those skilled in the art that various types of materials can be utilized in substitution therefor without departing from the teachings of the invention as defined in the appended claims.

I claim:

1. A cleaning and dusting assembly for venetian blinds and the like comprising: a brush frame having a rigid handle; a multiplicity of elongated, finger-like dusting brushes mounted in said frame and extending longitudinally therefrom, said dusting brushes being constituted by a plurality of brush filaments; a plurality of cleaning adapters mounted in operative relationship with said brushes, said cleaning adapters having elongated bores therein for receiving said brushes, each of said adapters including an elongated core member having a cleaning sleeve thereupon, said core member providing said bore for the reception of a respective brush; and detent means on said frame engageable with the inner extremity of each of said core members to maintain said adapters in overlying relationship with said filaments.

2. The assembly of claim 1 in which said detent means is formed integrally with said frame and said core members are rotatable relative to said detent means.

3. The assembly of claim 1 in which said detent means engage the inner extremities of said core members, said detent means being rotatable with said core members to permit relative rotation of said adapters with respect to said frame and said brushes.

4. The assembly of claim 1 in which each of said brushes includes an elongated filament retainer and said detent means are mounted for rotation on said filament retainer and are engageable with said adapters to rotate therewith.

* * * * *